US008114471B2

(12) United States Patent
Sheu

(10) Patent No.: US 8,114,471 B2
(45) Date of Patent: Feb. 14, 2012

(54) METHOD FOR MAKING A TRANSFER PATTERN THIN FILM

(75) Inventor: Victor Shi-Yueh Sheu, Taoyuan (TW)

(73) Assignees: Victor Shi-Yoeh Sheu, Taoyuan (TW); Sheng-Li Hsu, New Taipei (TW)

( * ) Notice: Subject to any disclaimer, the term of this patent is extended or adjusted under 35 U.S.C. 154(b) by 189 days.

(21) Appl. No.: 12/578,580

(22) Filed: Oct. 13, 2009

(65) Prior Publication Data

US 2011/0086168 A1 Apr. 14, 2011

(51) Int. Cl.
*B05D 1/02* (2006.01)
*B05D 1/26* (2006.01)

(52) U.S. Cl. ..... 427/152; 427/146; 427/258; 427/265

(58) Field of Classification Search ..... 427/146, 427/152, 258, 265
See application file for complete search history.

(56) References Cited

U.S. PATENT DOCUMENTS

2009/0208725 A1* 8/2009 Bailey et al. ..... 428/312.2
* cited by examiner

*Primary Examiner* — Frederick Parker
(74) *Attorney, Agent, or Firm* — Pai Patent & Trademark Law Firm; Chao-Chang David Pai

(57) ABSTRACT

A method for making a transfer-pattern thin film includes the step of preparing a compound mixture by mixing a hard coat material and a release material with a water-based, neutral or oil-based solvent, and the step of applying the compound mixture thus obtained to the surface of a thin film substrate, so that, due to the difference in specific gravity or molecule surface extension, or due to the effect of repulsive force, reaction mechanism or bonding force of physical changes and chemical actions, or of the difference in reaction rate, the hard coat substance and release substance are separated in the compound mixture to form a hard coat layer and a release layer, wherein the release layer is between the thin film substrate and the hard coat layer.

7 Claims, 4 Drawing Sheets

METHOD FOR MAKING A TRANSFER PATTERN THIN FILM

BACKGROUND OF THE INVENTION (a) Field of the Invention

The present invention relates to a transfer-pattern thin film fabrication method. More particularly, the present invention relates to a method for making a transfer-pattern thin film that assures quality consistency, improves manufacturing efficiency and lowers the manufacturing cost.

(b) Description of the Prior Art

As illustrated in FIGS. 1 and 2, an in-mold transfer-printing film or a transfer-printing thin film comprises a hard coat layer 10, an ink layer 20 coated or printed on the hard coat layer 10, a metal layer 30 coated on the ink layer 20 opposite to the hard coat layer 10, an adhesive layer 40 coated on the metal layer 30 opposite to the ink layer 20, a release layer 50 covered on the hard coat layer 10 opposite to the ink layer 20 and the release layer 50 covered on a thin-film substrate 60.

During IMD (in-mold decoration) transfer printing application, the adhesive layer 40 of the transfer-printing thin film or in-mold transfer-printing film is bonded to the surface of a plastic or metal member, for example, a cell phone cover or a notebook cover. By means of the release layer 50, the thin-film substrate 60 can be separated from the rest of the transfer-printing thin film or in-mold transfer-printing film, leaving the hard coat layer 10, the ink layer 20, the metal layer 30 and the adhesive layer 40 on the plastic or metal member so that the plastic or metal member has a smooth surface that carries a design. The term "hard coat layer 10" is so called because it generally provides a relatively hard outer surface layer (i.e. coat) for the plastic or metal member after the thin-film substrate 60 is separated with the release layer 50. In the following description, the material making up the hard coat layer 10 is called the "hard coat layer material" or "hard coat material" and the material making up the release layer is called the "release layer material" or "release material".

According to the aforesaid prior art design, the release layer 50 is coated on the surface of the thin-film substrate 60, the hard coat layer 10 is coated on the surface of the release layer 50. The fabrication is complicated because two separate steps must be performed to have the release layer 50 and the hard coat layer 10 covered on the thin-film substrate 60. Further, because the release layer 50 has a thickness within 1 μm~2 μm, the release layer 50 tends to be damaged during the manufacturing process, thus affecting product quality.

Therefore, it is desirable to provide a method for making a transfer-pattern thin film that eliminates the aforesaid problems.

SUMMARY OF THE INVENTION

The present invention has been accomplished under the circumstances in view. It is a main object of the present invention to provide a method for making a transfer-pattern thin film that assures quality consistency, improves manufacturing efficiency and lowers the manufacturing cost.

To achieve this and other objects of the present invention, a method for making a transfer-pattern thin film comprises the step of preparing a compound mixture by mixing a hard coat layer material and a release layer material, and the step of preparing a thin film substrate and applying the compound mixture to the surface of the thin film substrate for enabling the hard coat layer material and the release layer material to be separated in the compound mixture due to physical changes and chemical actions, thereby forming a hard coat layer and a release layer, wherein the release layer is between the thin film substrate and the hard coat layer.

DETAILED DESCRIPTION OF THE PREFERRED EMBODIMENTS

Figure 1:
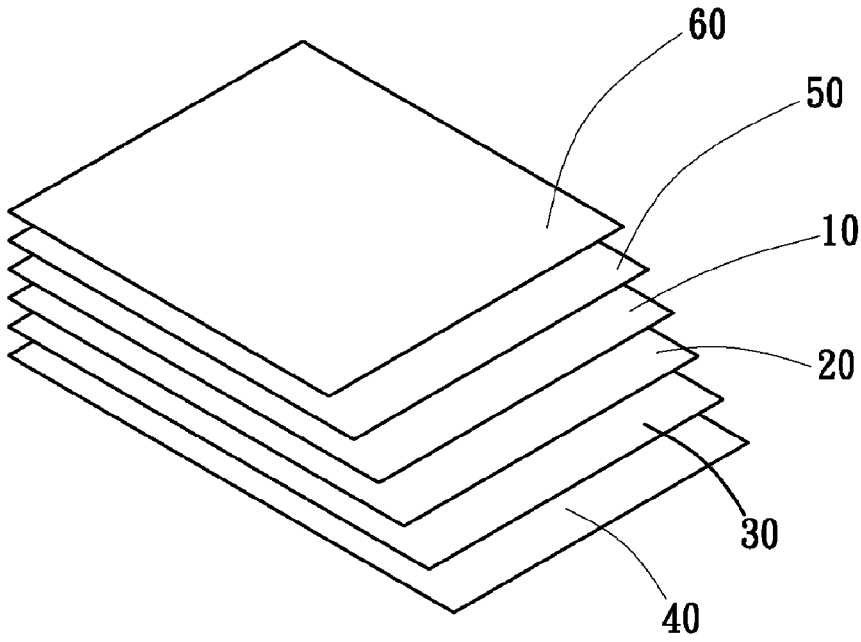
FIG. 1 PRIOR ART
FIG. 1 is an exploded view of an in-mold transfer-printing film prepared according to the prior art.
Figure 2:
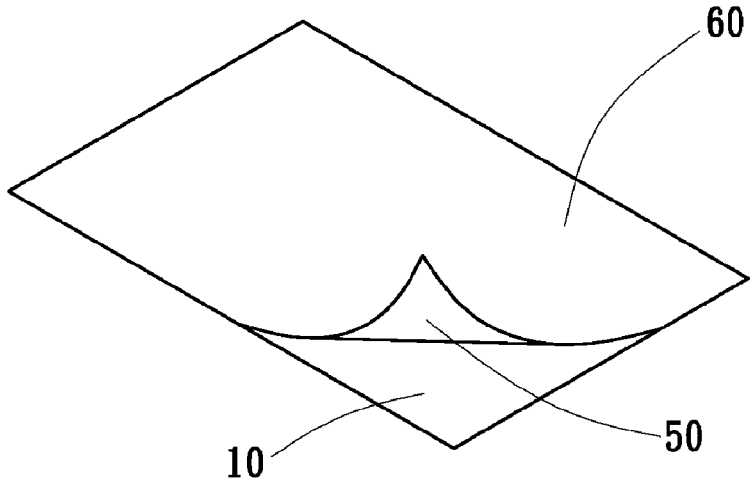
FIG. 2 PRIOR ART
FIG. 2 is a schematic drawing showing the release layer and the thin film substrate being separated from the rest of a transfer-printing thin film prepared according to the prior art.
Figure 3:
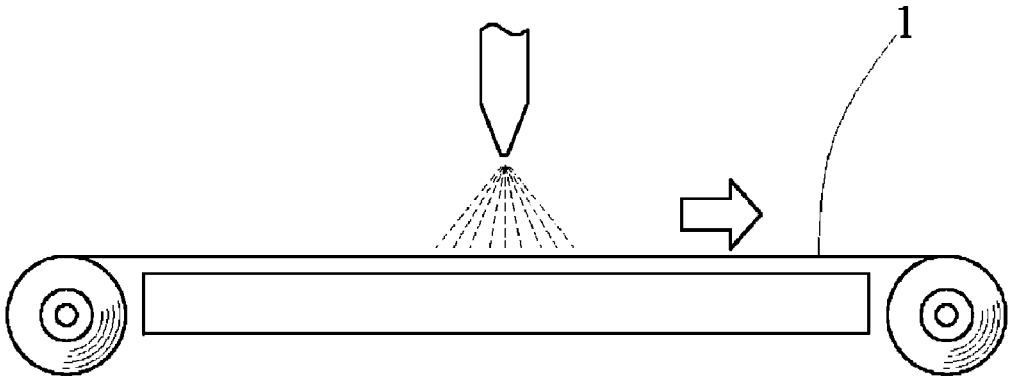
FIG. 3 is a schematic drawing, showing a compound mixture coating or spray-painting on a thin film substrate according to the present invention.
Figure 4:
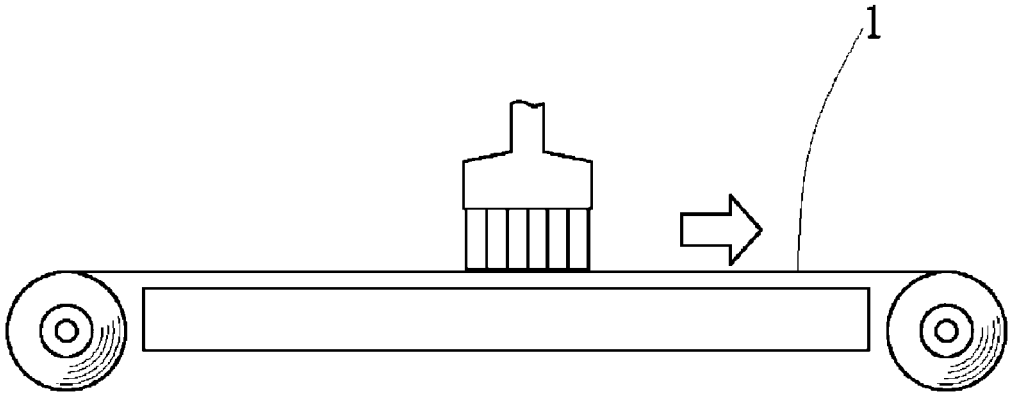
FIG. 4 is a schematic drawing, showing a compound mixture printing on a thin film substrate according to the present invention.

A method for making a transfer-pattern thin film in accordance with the present invention includes a step of preparing a compound mixture by mixing a liquid hard coat material and a liquid release material, or by mixing a powdered (solid) hard coat material and a powdered (solid) release material with a water-based, neutral or oil-based solvent. The compound mixture thus obtained is then applied to the surface of a thin film substrate 1 by coating or spray-painting (as shown in FIG. 3) or printing (as shown in FIG. 4).

Figure 5:
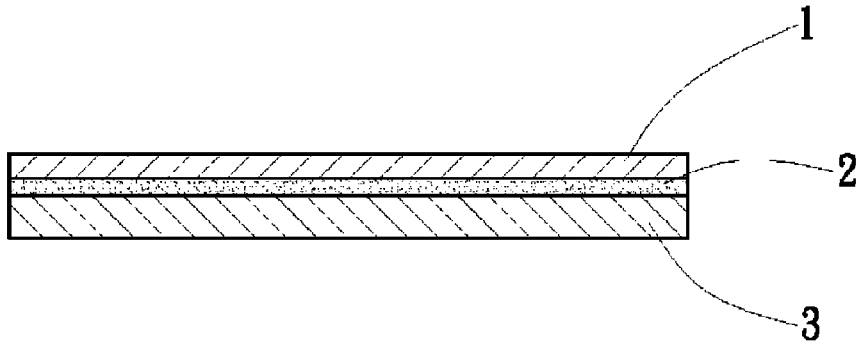
FIG. 5 is a sectional view, showing a hard coat layer and a release layer formed, wherein the release layer is between the thin film substrate and the hard coat layer according to the present invention.
Figure 6:
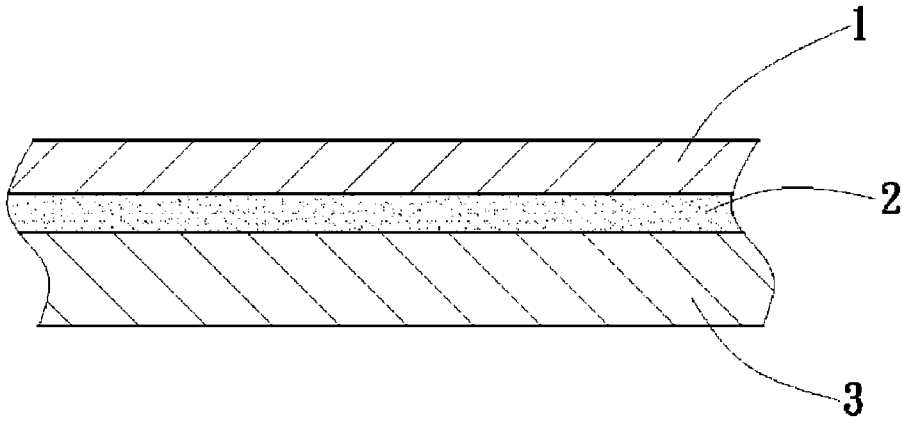
FIG. 6 is a sectional view illustrating the separation step.

In the transfer-pattern thin film, a release layer 2 and a hard coat layer 3 have a thickness within 5 μm~3 μm. Due to the difference in specific gravity or molecule surface extension, or due to the effect of repulsive force, reaction mechanism or bonding force of physical changes and chemical actions, or the difference in reaction rate, the hard coat substance and the release substance are separated in the compound mixture, thereby forming a hard coat layer 3 and a release layer 2, wherein the release layer 2 is between the thin film substrate 1 and the hard coat layer 3, as shown in FIGS. 5 and 6. The thin film substrate 1 can be prepared from a chemical reaction engineering thermosetting resin and/or thermoplastic resin, such as PU (polyurethane), UP (unsaturated polyester), PC (polycarbonate), PET (polyethylene terephthalate) or PS (polystyrene). The hard coat material and the release material can be PET (polyethylene terephthalate), PVA (polyvinyl alcohol), PS (polystyrene), PU (polyurethane) or UP (unsaturated polyester). The weight and molar ratio of the substances of the compound mixture is determined according to the desired thickness of the release layer and the hard coat layer.

Figure 7:
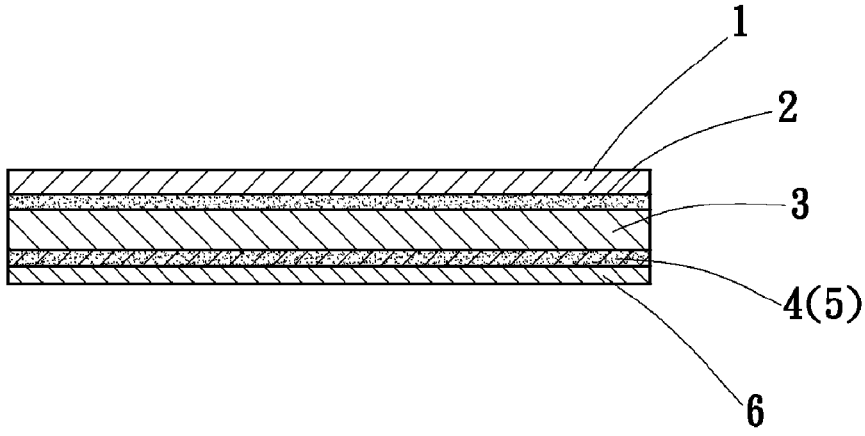
FIG. 7 is a schematic sectional view of the present invention, showing a pattern layer/metal layer on the hard coat layer and an adhesive layer on the pattern layer/metal layer.

Referring to FIG. 7, a pattern layer 4 or metal layer 5 may be coated on the surface of the hard coat layer 3 opposite to the release layer 2 and the thin film substrate 1. The pattern layer 4 can be coated on the hard coat layer 3 by means of coating, spray-painting, silk screen-printing, offset printing, letterpress printing, intaglio printing or computer printing, for the purpose of showing a design of a figure, lines, letters, symbols or numerals. The metal layer 5 can be coated on the hard coat layer 3 by means of electroplating, sputtering deposition, evaporation deposition, or any of a variety of known metal ion coating techniques. Finally, an adhesive layer 6 is coated on the pattern layer 4 or the metal layer 5, whichever is the case. The transfer-pattern thin film thus obtained can then be used for IMD (in-mold decoration) transfer pattern application.

Figure 8:
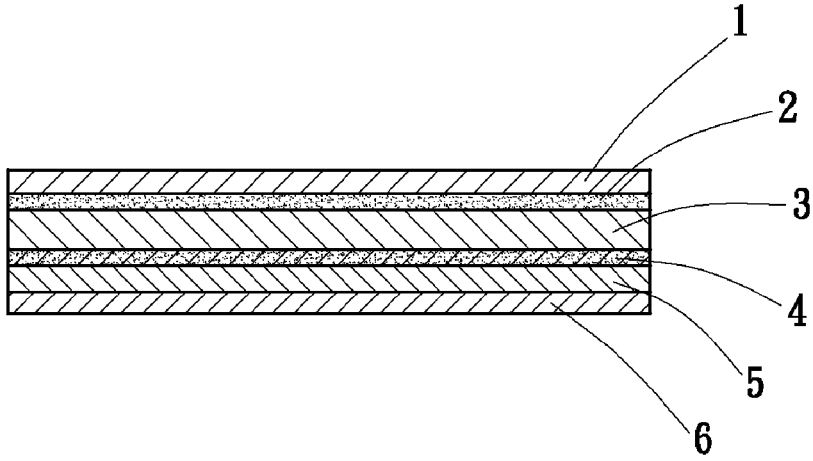
FIG. 8 is a schematic sectional view of the present invention, showing a pattern layer on the hard coat layer, a metal layer on the pattern layer and an adhesive layer on the metal layer.

In an alternate form of the present invention, as shown in FIG. 8, a pattern layer 4 is coated on the surface of the hard coat layer 3 opposite to the release layer 2 and the thin film substrate 1, and then a metal layer 5 is coated on the surface of the pattern layer 4 opposite to the hard coat layer 3. The pattern layer 4 can be coated on the hard coat layer 3 by means of coating, spray-painting, silk screen-printing, offset printing, letterpress printing, intaglio printing or computer printing, for the purpose of showing a design of a figure, lines, letters, symbols or numerals. The metal layer 5 can be coated on the pattern layer 4 opposite to the hard coat layer 3 by means of electroplating, sputtering deposition, evaporation deposition, or any of a variety of known metal ion coating techniques. Finally, an adhesive layer 6 is coated on the metal layer 5. The transfer-pattern thin film thus obtained can then be used for IMD (in-mold decoration) transfer pattern application.

As stated above, a transfer-pattern thin film fabrication method in accordance with the present invention prepares a compound mixture by mixing a hard coat material and a release material, and then applies the compound mixture thus obtained to the surface of a thin film substrate, so that, due to the difference in specific gravity or molecule surface extension, or due to the effect of repulsive force, reaction mechanism or bonding force of physical changes and chemical actions, or the difference in reaction rate, the hard coat substance and the release substance are separated in the compound mixture to form a hard coat layer 3 and a release layer 2, wherein the release layer 2 is between the thin film substrate 1 and the hard coat layer 3. Thereafter, a pattern layer 4 or a metal layer 5 is coated on the hard coat layer 3, or a pattern layer 4 and a metal layer 5 are coated on the hard coat layer 3 in order, and finally an adhesive layer 6 is coated on the pattern layer 4 or metal layer 5, whichever is the case. This transfer-pattern thin film fabrication method is simple assures quality consistency, improves manufacturing efficiency and lowers the manufacturing cost.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A method for making a transfer-pattern film, comprising the step of preparing a compound mixture by mixing a hard coat material and a release material, and the step of preparing a film substrate and applying said compound mixture to one side of said film substrate for enabling said hard coat material and said release material to be separated in said compound mixture due to physical changes and chemical actions, thereby forming a hard coat layer and a release layer, wherein the release layer is between said film substrate and said hard coat layer, wherein each of the hard coat material and the release material is PET (polyethylene terephthalate), PVA (polyvinyl alcohol), PS (polystyrene), PU (polyurethane) or UP (unsaturated polyester).

2. The method of claim 1, wherein said hard coat material and said release material are liquefied.

3. The method of claim 1, wherein said hard coat material and said release material are in powder form and mixed with a water-based, neutral or oil-based solvent.

4. The method of claim 1, wherein said hard coat material and said release material are mixed with a prespecified weight and molar ratio in order to result in a desired thickness of the release layer and the hard coat layer.

5. The method of claim 1, wherein said film substrate is a plastic film prepared from a thermosetting resin or thermoplastic resin.

6. The method of claim 1, further comprising the step of coating a pattern layer or a metal layer on said hard coat layer.

7. The method of claim 1, further comprising the step of coating a pattern layer on said hard coat layer and coating a metal layer on said pattern layer.

* * * * *